US006159088A

United States Patent [19]

Nakajima

[11] Patent Number: 6,159,088

[45] Date of Patent: Dec. 12, 2000

[54] POLISHING PAD, POLISHING APPARATUS AND POLISHING METHOD

[75] Inventor: Hideharu Nakajima, Kanagawa, Japan

[73] Assignee: Sony Corporation, Tokyo, Japan

[21] Appl. No.: 09/239,779

[22] Filed: Jan. 29, 1999

[30] Foreign Application Priority Data

Feb. 3, 1998 [JP] Japan ..... 10-022164

[51] Int. Cl.[7] ..... B24D 11/00

[52] U.S. Cl. ..... 451/527; 451/550; 451/551

[58] Field of Search ..... 451/527, 530, 451/550, 551, 921

[56] References Cited

U.S. PATENT DOCUMENTS 5,216,843 6/1993 Breivogel et al. ..... 51/131.1
5,650,039 7/1997 Talieh ..... 156/636.1
5,690,540 11/1997 Elliott et al. ..... 451/41
5,778,481 7/1998 Amsden et al. ..... 15/230
5,882,251 3/1999 Berman et al. ..... 451/527
5,899,799 5/1999 Tjaden et al. ..... 451/287
5,921,855 7/1999 Osterheld et al. ..... 451/527
5,984,769 11/1999 Bennett et al. ..... 451/527

*Primary Examiner*—Joseph J. Hail, III
*Assistant Examiner*—William Hong
*Attorney, Agent, or Firm*—Ronald P. Kananen; Rader, Fishman & Grauer

[57] ABSTRACT

A polishing pad for chemical mechanical polishing capable of simultaneously realizing a reduction of process costs by the reduction of the amount of usage of a polishing slurry and an improvement of a polishing quality of a wafer surface, and a polishing apparatus and a polishing method using the same, provided with a first area A at a side of a predetermined radial line R of the polishing pad in the direction of rotation or advance 30 of the polishing pad, a second area B at an opposite side thereof, and grooves having projecting portions 203 in a direction opposite to the direction of rotation or advance 30 of the polishing pad formed only in the second area B.

16 Claims, 9 Drawing Sheets

POLISHING PAD, POLISHING APPARATUS AND POLISHING METHOD

BACKGROUND OF THE INVENTION

1. Field of the Invention

The present invention relates to a polishing pad used when flattening an inter-layer insulating film by the chemical mechanical polishing (CMP) method in a process for manufacture of a semiconductor device and to a polishing apparatus and a polishing method using this polishing pad.

2. Description of the Related Art

In recent years, semiconductor integrated circuits have been advancing to the next generation of miniaturization and integration in as little as three years. The design rule has been reduced to 70% of the previous generation and along with the reduction, an increase in the speeds of semiconductor devices has been realized. In order to miniaturize semiconductor devices, for example, it has become necessary to reduce the gate width of the gate electrodes of the transistors and the area occupied by the capacitors in DRAM's and the like and to similarly miniaturize the interconnection portions such as by adopting a multilayer interconnection structure. Further, it has become important to form the contact holes and the like to similarly have miniature openings. Also, along with devices such as the transistors and the capacitors becoming more complicated in structure and three-dimensional, the inter-layer insulating films have become thicker.

The above miniaturization has been achieved by the advances made in miniaturization technology in the process of manufacture of semiconductor devices, in particular the improvement of the resolving power in the lithography process—that is, the technique for using light to transfer a circuit pattern on to a photosensitive organic film (photoresist) coated on a wafer surface. Specifically, the wavelength of the light source used in the lithography process has been shortened. For example, g-rays (436 nm) or i-rays (365 nm) are used for transferring patterns for semiconductor integrated circuits of the 1.0 to 0.5 $\mu$m rule, while i-rays are mainly used for transferring patterns of the 0.35 $\mu$m rule. Further, for the manufacture of semiconductor integrated circuits of the 0.25 $\mu$m rule and beyond, a technique for exposure by using a KrF excimer laser (248.8 nm) or an ArF excimer laser (193 nm) has been studied.

As described above, the improvement of the resolution in the lithography process is on the one hand bringing about a reduction of the depth of focus (DOF) of exposure in the lithography process. Realization of improvement of DOF will first require improvement of the performance of the resist, but demands for miniaturization are currently being made in advance of improvements in the resist performance under existing circumstances. Therefore, a method for reducing the difference of height in the structure of devices as much as possible so as to make up for the insufficient depth of focus when performing the lithography process so as thereby to achieve reliable resolution of miniature patterns without causing focal deviation is being studied.

In this regard, as a method for flattening the height differences in a device structure, recently use has been made of the chemical mechanical polishing method to give the silicon wafer a mirror surface finish. FIG. 1 is a schematic view of a general chemical mechanical polishing apparatus used in the related art for performing this chemical mechanical polishing. This apparatus is roughly constituted by a rotating polishing plate shaft 1, a polishing pad 2, a polishing plate 3 which is supported by the shaft 1 and on whose surface the pad 2 is adhered, a dresser 101 comprised of diamonds 102 etc. electrodeposited on a metal plate and for dressing the surface of the polishing pad 2, a carrier 5 for holding a processed substrate 4 on which an inter-layer insulating film or other layer for polishing is formed (hereinafter also referred to as a "wafer") by a wafer backing film 14, and a polishing slurry delivery system 7 having a polishing slurry delivery nozzle 6 for delivering the polishing slurry 10 onto the polishing pad 2.

After dressing (grinding) the polishing pad 2 by a dresser 101, the polishing plate shaft 1 and a carrier shaft 8 are made to rotate and the wafer 4 is made to press against the top of the polishing pad 2 to polish the wafer 4 by a polishing pressure adjustment mechanism 9 while delivering the polishing slurry 10 to the center portion of the polishing pad 2 from the polishing slurry delivery nozzle 6.

The chemical mechanical polishing method described above, however, suffers from the problems that microscratches occurs in the insulating film of the wafer or other polished layer and that the variations in the polishing rate and the variations in the amounts of polishing in the plane of the wafer are large.

In order to suppress the occurrence of the microscratches, it is necessary to eject the dressing dross of the polishing pad 2 and the diamonds of the dresser generated at the time of dressing of the polishing pad 2, the pieces of the inter-layer film and wafer, and the used polishing slurry, etc. (hereinafter these will also be referred to generally as "impurities") to the outside of the polishing pad 2.

Therefore, in the chemical mechanical polishing apparatus of the related art, the measure has been taken of continuously delivering a sufficient amount of the polishing slurry to the center portion of the polishing pad 2 during the polishing work so as to remove or flush away these impurities from the polishing pad 2 by this polishing slurry.

The reduction of the variations in the polishing rate and the variations in the amounts of polishing in the plane of the wafer require that the following approach be adopted. The principle of chemical mechanical polishing is to form a so-called shallow dressed layer at the surface of the polishing pad 2 by making innumerable scratches on the surface of the polishing pad 2 by a dresser and to polish the wafer 4 in a state with the polishing slurry 10 held in the same so as to enable sufficient delivery of the polishing slurry to the polishing surface of the wafer 4 pressed against the polishing pad 2 and thereby to enable polishing. Taking this into account, the practice has been to dress the surface of the polishing pad by the dresser sufficiently so as to give a sufficient depth and density of the dressed layer and to sufficiently deliver the polishing slurry 10, which also serves as the measure to prevent microscratches, and ensure that the polishing slurry 10 reaches the surface of the wafer 4. This approach constitutes the means for the reduction of the variations in the polishing rate and the variations in the amount of polishing in the plane of the wafer.

However, when forming the dressed layer on the pad surface by dressing in this way and delivering the polishing slurry to polish a wafer, the polishing slurry is pushed out due to the centrifugal force caused by the rotation of the polishing pad and by pressing the wafer against the polishing pad. Almost all ends up being ejected to the outside of the polishing pad without directly contributing to the polishing. Therefore, the expensive polishing slurry ends up being wasted. For this reason, as shown in FIG. 2, in the related art, experiments have been made to cut for example lattice-like grooves 21 in the polishing pad 200 and store the polishing slurry there to increase the opportunity for contact to the wafer.

In the above structure, however, there was a problem in that the polishing slurry ended up being easily ejected to the outside of the polishing pad. In order to solve this problem, a polishing pad out with concentric circular grooves 22 about the center of the polishing pad 200 as shown in FIG. 3 was considered. However, even with this, in actuality, the problems remained that the polishing slurry held in the grooves 22 remained only at the outer circumferences of the grooves due to the centrifugal force and otherwise ended up being ejected to the outside of the polishing pad and that the position at which the polishing slurry held in the concentric circular grooves 22 of the polishing pad started to flow out over the grooves was not constant and therefore the polishing slurry did not always flow out to the front of the wafer.

The fact that the polishing slurry is not effectively utilized and ends up being ejected to the outside of the polishing pad in this way raises the cost of the chemical mechanical polishing. At the same time, since the polishing slurry does not sufficiently contribute to the polishing, there is the apprehension of a reduction of the quality of polishing such as the occurrence of microscratches on the polished surface or variations in the amount of the polishing.

SUMMARY OF THE INVENTION

The present invention was made in consideration with the above problems and has as its object to provide a polishing pad for chemical mechanical polishing for flattening etc. an inter-layer insulating film in the process of manufacture of a semiconductor device wherein, in addition to the formation of a dressed layer of the polishing pad by dressing of the pad by a dresser as in the related art, grooves are formed optimized in shape so that ejection of the polishing slurry from the top of the polishing pad to the outside of the polishing pad due to just the centrifugal force is prevented as much as possible and that this polishing slurry is selectively delivered forward in a direction of advance of the wafer so that it becomes possible to effectively utilize the polishing slurry at the time of polishing for its originally intended polishing and thereby enabling simultaneous achievement of a reduction of the process cost by the reduction of the amount of usage of the polishing slurry and an improvement of the polishing quality such as the polished shape of the wafer surface and the uniformity of polish by the increase of the opportunity of contact of the polishing slurry with the wafer, and to provide a polishing apparatus and a polishing method using the same.

According to a first aspect of the present invention, there is provided a polishing pad used for polishing by the chemical mechanical polishing method, comprising a first area at a side of a predetermined radial line of the polishing pad in the direction of rotation or advance of the polishing pad, a second area at an opposite side thereof, and grooves having projecting portions in a direction opposite to the direction of rotation or advance of the polishing pad formed only in the second area.

According to a second aspect of the present invention, there is provided a polishing apparatus using that polishing pad and according to a third aspect, there is provided a polishing method using that polishing pad.

Due to these aspects of the invention, when delivering polishing slurry to the center of the polishing pad while the polishing pad is being rotated, the grooves can receive the polishing slurry which is ejected to the outside of the polishing pad due to the centrifugal force accompanying the rotation of the polishing pad. Further, the once received polishing slurry can be selectively delivered forward in the direction of advance of the wafer. Accordingly, in addition to holding the polishing slurry to the dressing layer used in the chemical mechanical polishing method as in the related art, it is possible to positively recover and hold the polishing slurry itself in the grooves and selectively deliver the polishing slurry from the grooves to the wafer, to make more effective use of the polishing slurry at the time of chemical mechanical polishing, to reduce the process costs through reduction of the amount of the polishing slurry used, and to increase the opportunity for contact of the polishing slurry with the wafer to improve the quality of polish such as the polished shape and the uniformity of polish of the surface of the wafer.

Preferably, the grooves formed in the polishing pad are comprised of a plurality of straight grooves. Alternatively, the grooves formed in the polishing pad are comprised of a plurality of arc-shaped grooves. Further, the plurality of straight grooves or arc-shaped grooves can be shaped to project out in a direction opposite to the direction of rotation or advance of the polishing pad. Due to this, in the same way as above, it is possible to reduce the process costs through reduction of the amount of the polishing slurry used, and to increase the opportunity for contact of the polishing slurry with the wafer to improve the quality of polish such as the polished shape and the uniformity of polish of the surface of the wafer.

Alternatively, preferably, the grooves formed in the polishing pad are comprised of a plurality of straight or arc-shaped grooves and have a plurality of projecting portions in a direction opposite to the direction of rotation or advance of the polishing pad. Due to this, it is possible to selectively deliver the recovered polishing slurry from the above plurality of projecting portions to the wafer, to make the contact of the polishing slurry with the wafer even more uniform, and further improve the quality of polish such as the polished shape and the uniformity of polish of the surface of the wafer.

Alternatively, preferably, the grooves formed in the polishing pad are comprised of a plurality of straight or arc-shaped grooves and have extending portions which project out in a direction opposite to the direction of rotation or advance of the polishing pad at said projecting portions. Due to this, it is possible to facilitate the selective delivery of the recovered polishing slurry from the extending portions of the wafer, to make the contact of the polishing slurry with the wafer even more uniform, and further improve the quality of polish such as the polished shape and the uniformity of polish of the surface of the wafer.

Alternatively, preferably, the grooves formed in the polishing pad extend from an outer peripheral edge to center of the polishing pad in a direction opposite to the direction of rotation of the polishing pad, are comprised of straight or arc-shaped grooves, and have extending portions which project out in a direction opposite to the direction of rotation or advance of the polishing pad at least at one location per groove. Since the grooves formed in the polishing pad extend from an outer peripheral edge to center of the polishing pad in a direction opposite to the direction of rotation of the polishing pad, it is possible to reduce even more the ejection of the recovered polishing slurry to the outside of the polishing pad due to the centrifugal force, to improve the ability of the grooves to hold the polishing slurry and thereby reduce the amount of the polishing slurry used, and to increase the opportunity for contact of the polishing slurry with the wafer. Further, selective delivery of the recovered polishing slurry from the extending portions to the wafer becomes easier.

Alternatively, preferably, the grooves formed in the polishing pad extend from an outer peripheral edge to center of the polishing pad in a direction opposite to the direction of rotation of the polishing pad and have a plurality of projecting portions in a direction opposite to the direction of rotation or advance of the polishing pad. Since the grooves formed in the polishing pad extend from an outer peripheral edge to center of the polishing pad in a direction opposite to the direction of rotation of the polishing pad, it is again possible to reduce even more the ejection of the recovered polishing slurry to the outside of the polishing pad due to the centrifugal force, to improve the ability of the grooves to hold the polishing slurry and thereby reduce the amount of the polishing slurry used, and to increase the opportunity for contact of the polishing slurry with the wafer. Further, selective delivery of the recovered polishing slurry from the plurality of projecting portions to the wafer becomes easier.

Preferably, the polishing pad is formed of a material selected from foamed polyurethane, nonfoamed polyurethane, a silicone resin, polyethylene fluoride resin, polyvinyl chloride resin, hard rubber, and mixtures of the same. By selecting suitable materials, it is possible to make the polishing pad one with a hardness and elasticity suitable for the polishing and possible to improve the polishing efficiency and the quality of polish.

BRIEF DESCRIPTION OF THE DRAWINGS

Above and other objects and features of the present invention will become more apparent from the following description of the preferred embodiments given with reference to the attached drawings, in which.

DESCRIPTION OF THE PREFERRED EMBODIMENTS

Below, preferred embodiments of the present invention will be explained with reference to the drawings.

Figure 1:
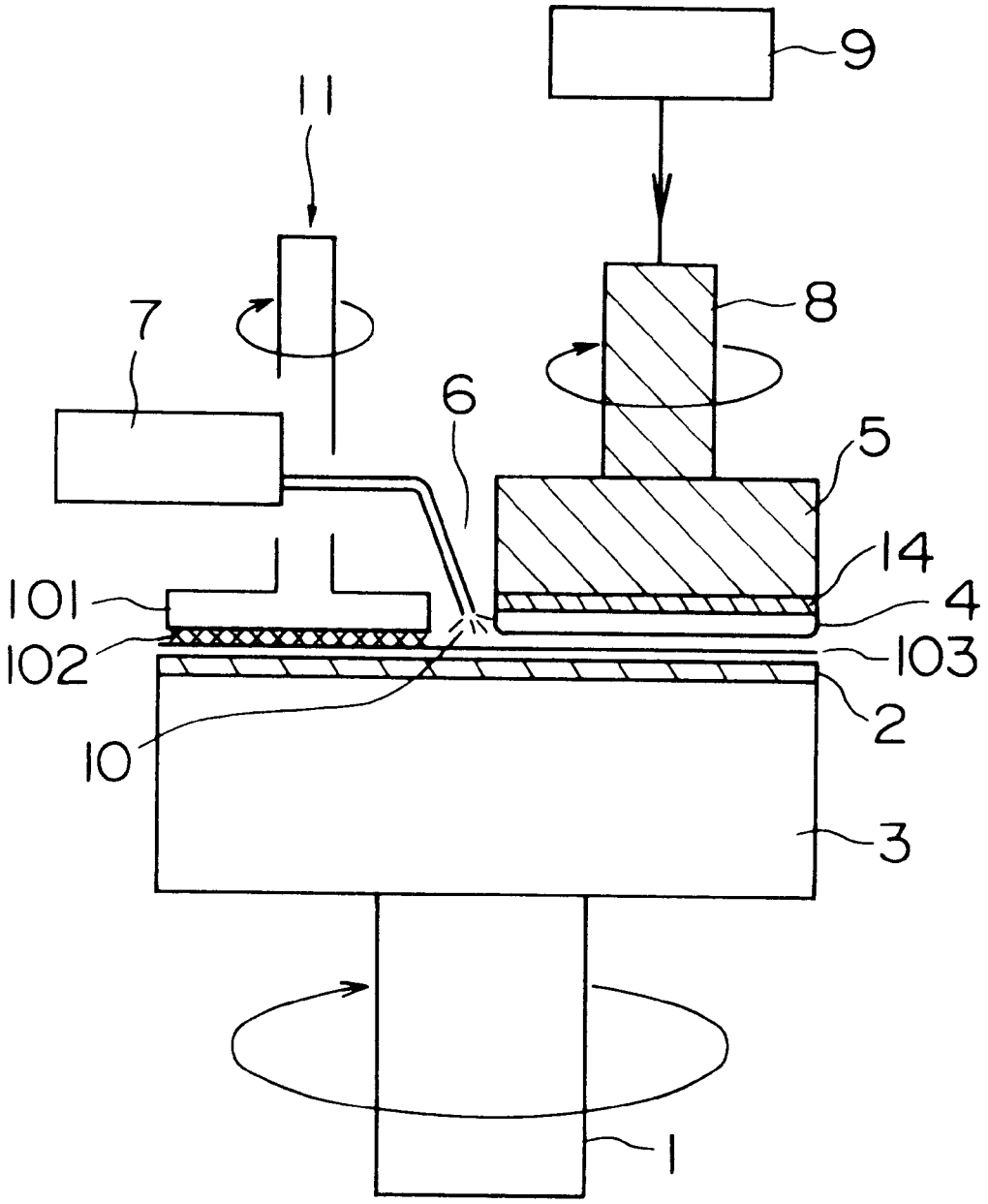
FIG. 1 is schematic view of a general chemical mechanical polishing apparatus used in the present invention.
Figure 2:
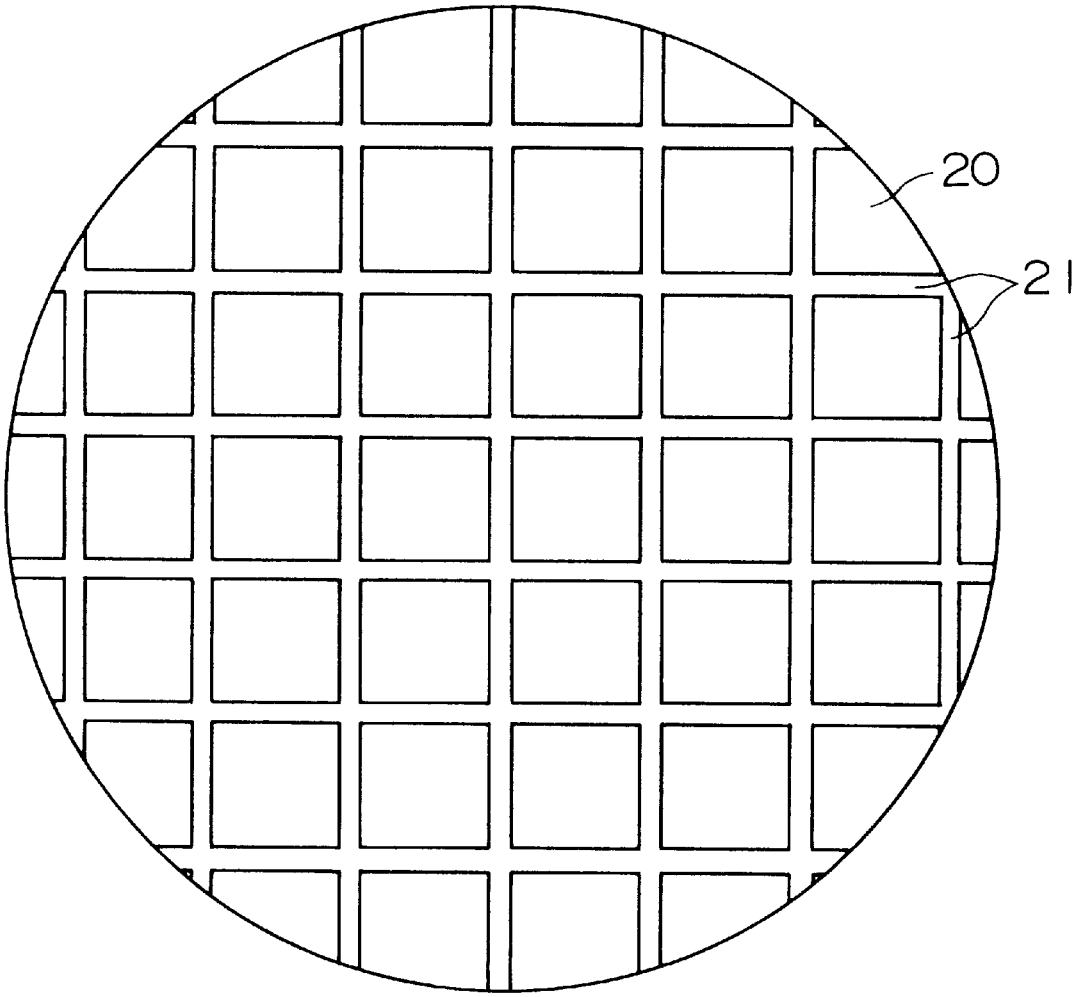
FIG. 2 is a schematic view of a pattern of grooves formed in a polishing pad according to a first related art.
Figure 3:
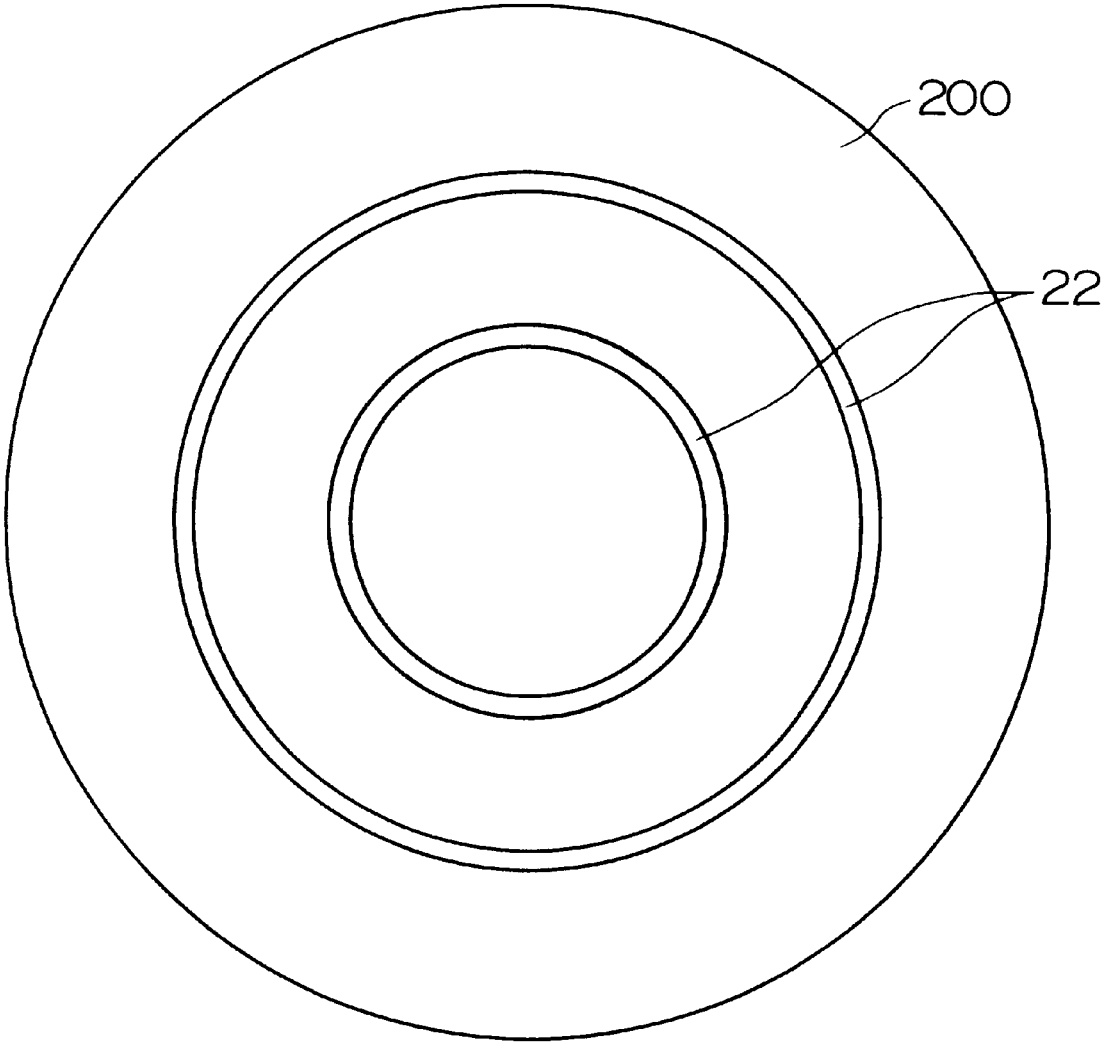
FIG. 3 is a schematic view of a pattern of grooves formed in a polishing pad according to a second related art.

FIG. 1 is a schematic view of a general chemical mechanical polishing apparatus used in the present invention. This apparatus is roughly constituted by a polishing platen 3 which is supported by a rotating polishing platen shaft 1 and which has a polishing pad 2 adhered on its surface, a dresser 101 comprised of diamonds 102 or the like electrodeposited on a metal plate for dressing the surface of the polishing pad 2, a carrier 5 for holding a processed substrate 4 on which a polishing layer such as an inter-layer insulating film is formed (hereinafter also referred to as a wafer) by a wafer backing film 14, and a polishing slurry delivery system 7 having a polishing slurry delivery nozzle 6 for delivering the polishing slurry 10 onto the polishing pad 2.

The polishing pad 2 is dressed by the dresser 101, then the polishing plate shaft 1 and the carrier shaft 8 are rotated and the wafer 4 is pressed against the top of the polishing pad 2 by a polishing pressure adjustment mechanism 9 while delivering the polishing slurry 10 to the center portion of the polishing pad 2 from the polishing slurry delivery nozzle 6 to polish the wafer 4.

Here, the polishing pad 2 is provided with a first area at a side of a predetermined radial line of the polishing pad in the direction of rotation or advance of the polishing pad, a second area at an opposite side thereof, and grooves having projecting portions in a direction opposite to the direction of rotation or advance of the polishing pad formed only at the second area. For example, grooves 23 are formed in a polishing pad base 200 like in the polishing pad shown in FIG. 4. Here, the side of a radial line R on the polishing pad in the direction of rotation or advance 30 of the polishing pad is defined as a first area A and the opposite side thereof is defined as a second area B. A groove 23 having a projecting portion 203 in the direction opposite to the direction of rotation or advance 30 of the polishing pad is formed only at the second area B. The first area A may also have a groove not having a projecting portion in the direction opposite to the direction of rotation or advance 30 of the polishing pad.

The polishing pad 2 is formed by a material selected from for example a foamed polyurethane, nonfoamed polyurethane, a silicone resin, polyethylene fluoride resin, polyvinyl chloride resin, a hard rubber, and mixtures thereof.

The grooves formed in the polishing pad 2 can be constituted by for example a plurality of straight grooves or arc-shaped grooves. Alternatively, they can be constituted by straight or arc-shaped grooves which have a plurality of projecting portions in the direction opposite to the direction of rotation or advance of the polishing pad. Still further, they can be constituted by straight or arc-shaped grooves which have extending portions projecting out in the direction opposite to the direction of rotation or advance of the polishing pad at the projecting portions. Further, they can be constituted by straight or arc-shaped grooves which extend from an outer peripheral edge to the center of the polishing pad in the direction opposite to the direction of rotation of the polishing pad and have extending portions which project out in a direction opposite to the direction of rotation or advance of the polishing pad at least at one location per groove. Further, they can be constituted by grooves which extend from an outer peripheral edge to center of the polishing pad in a direction opposite to the direction of rotation of the polishing pad and have a plurality of projecting portions in a direction opposite to the direction of rotation or advance of the polishing pad.

According to the polishing pad 2 of the present embodiment, when delivering polishing slurry 10 to the center of the polishing pad 2 while the polishing pad 2 is being rotated, the grooves can receive the polishing slurry 10 which is ejected to the outside of the polishing pad 2 due to the centrifugal force accompanying the rotation of the polishing pad 2. Further, the once received polishing slurry can be selectively delivered forward in the direction of advance of the wafer 4. Accordingly, in addition to holding the polishing slurry 10 to the dressing layer used in the chemical mechanical polishing method as in the related art, it is possible to positively recover and hold the polishing slurry 10 itself in the grooves and selectively deliver the polishing slurry 10 from the grooves to the wafer 4, to make more effective use of the polishing slurry 10 at the time of chemical mechanical polishing, to reduce the process costs through reduction of the amount of the polishing slurry 10 used, and to increase the opportunity for contact of the polishing slurry 10 with the wafer 4 to improve the quality of polish such as the polished shape and the uniformity of polish of the surface of the wafer 4.

Further, regarding the grooves described above, by shaping them so as to have extending portions projecting out in the direction opposite to the direction of rotation or advance of the polishing pad or shaping the grooves so as to extend from the outer peripheral edge to the center of the polishing pad in the direction opposite to the direction of rotation of the polishing pad, becomes possible to further reduce the process costs by the reduction of the amount of usage of the polishing slurry 10 and increase the opportunity of contact of the polishing slurry 10 with the wafer 4 to further improve the polishing quality such as the polished shape and polishing uniformity of the surface of the wafer 4.

First Embodiment

Figure 4:
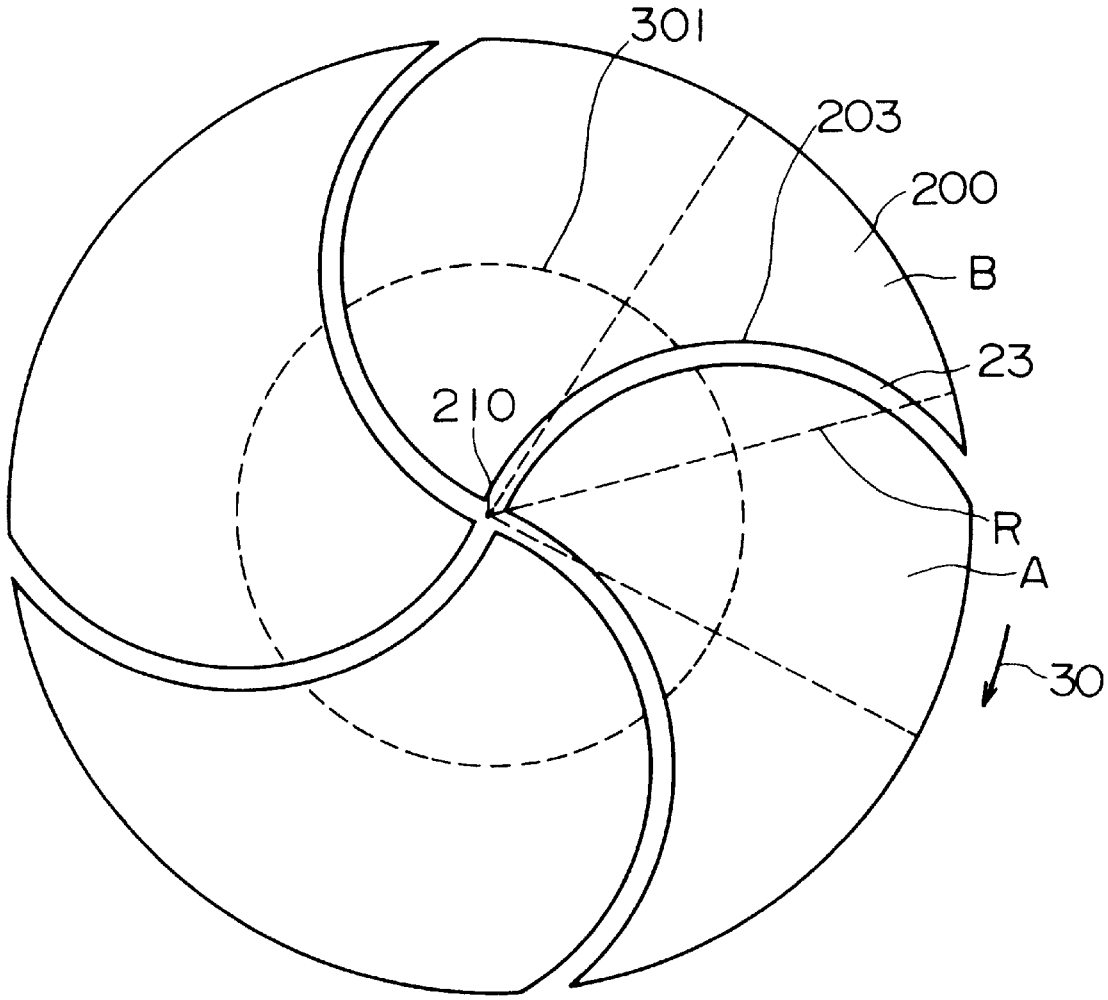
FIG. 4 is a schematic view of a pattern of grooves formed in a polishing pad according to a first embodiment of the present invention.

FIG. 4 shows a pattern of grooves formed in a polishing pad according to a first embodiment of the present invention. A groove 23 formed in the polishing pad base 200 is formed, with respect to the direction of rotation 30 of the polishing pad, so as to head in the direction of advance of the polishing pad as it heads toward the outer peripheral edge of the polishing pad. The groove of the polishing pad is further formed so that it has the largest projecting portion 203 in a direction opposite to the direction of advance of the polishing pad at the portion of a line 301 through which the center of the polished wafer passes.

When the polishing pad is rotated while delivering the polishing slurry to the center portion 210 of the polishing pad, the polishing slurry will spread out toward the outer periphery of the polishing pad due to the centrifugal force, but if the polishing pad of the present embodiment is used, the polishing slurry trying to flow out of the polishing pad due to the centrifugal force is positively collected in this groove 23 and the accumulated polishing slurry is released again backward in the direction of rotation of the polishing pad from only the portion of the groove portion 203 having the largest projecting portion and selectively delivered to the polished wafer passing through there. Due to this, the polishing slurry is sufficiently delivered at the time of polishing of the polished wafer, so effective utilization of the polishing slurry and enhancement of quality of the polishing become possible.

The polishing pad of the present embodiment can be used while being mounted in the polishing apparatus shown in for example FIG. 1. Further, it is possible to polish a processed substrate by using this polishing apparatus.

Second Embodiment

Figure 5:
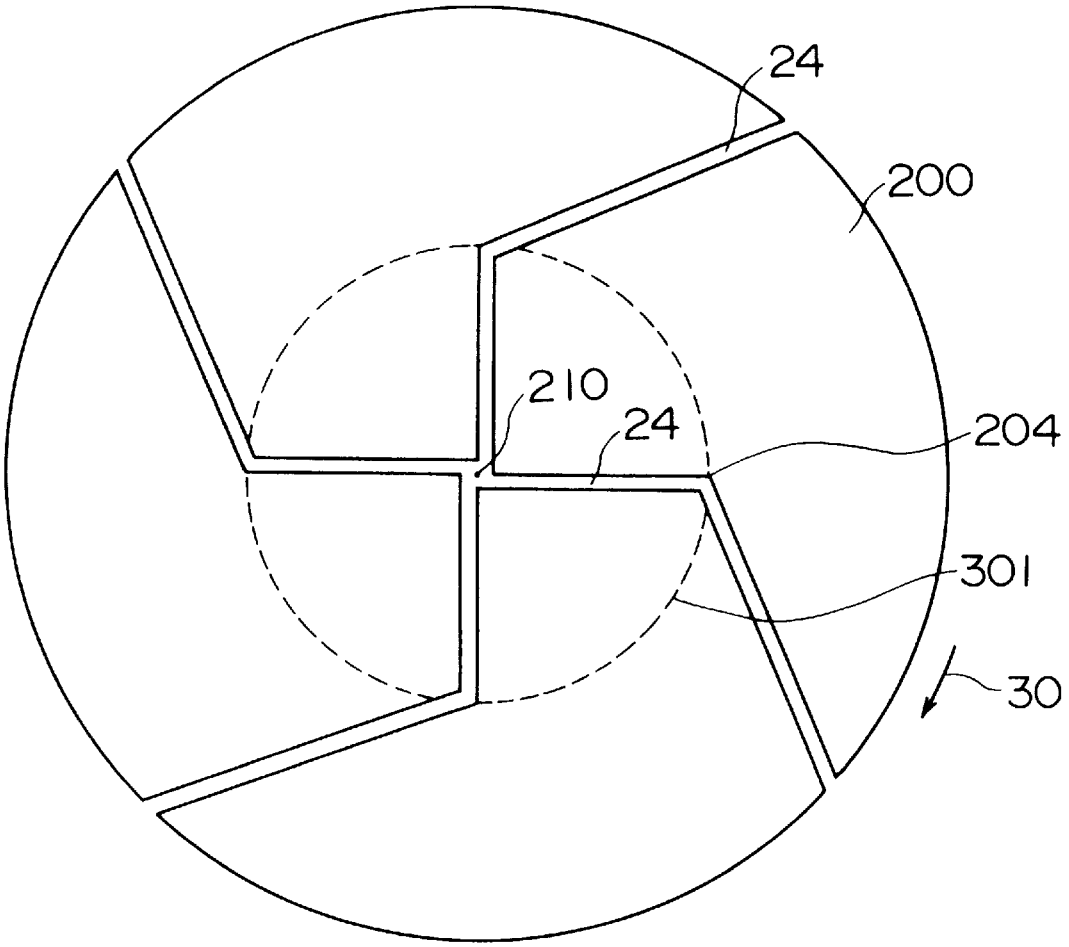
FIG. 5 is a schematic view of a pattern of grooves formed in a polishing pad according to a second embodiment of the present invention.

FIG. 5 shows a pattern of grooves formed in a polishing pad according to a second embodiment of the present invention. This is substantially the same as the first embodiment, but a groove 24 of the polishing pad base 200 is constituted by straight lines forming a projecting angle 204 in a direction opposite to the direction of advance of the polishing pad at the portion of the line 301 through which the center of the polished wafer passes. According to the polishing pad of the present embodiment, in the same way as the first embodiment, the polishing slurry is sufficiently fed at the time of polishing of the polished wafer, whereby the effective utilization of the polishing slurry and the enhancement of the quality of the polishing become possible.

The polishing pad of the present embodiment can be used while being mounted in the polishing apparatus shown in for example FIG. 1. Further, it is possible to polish a processed substrate by using this polishing apparatus.

Third Embodiment

Figure 6:
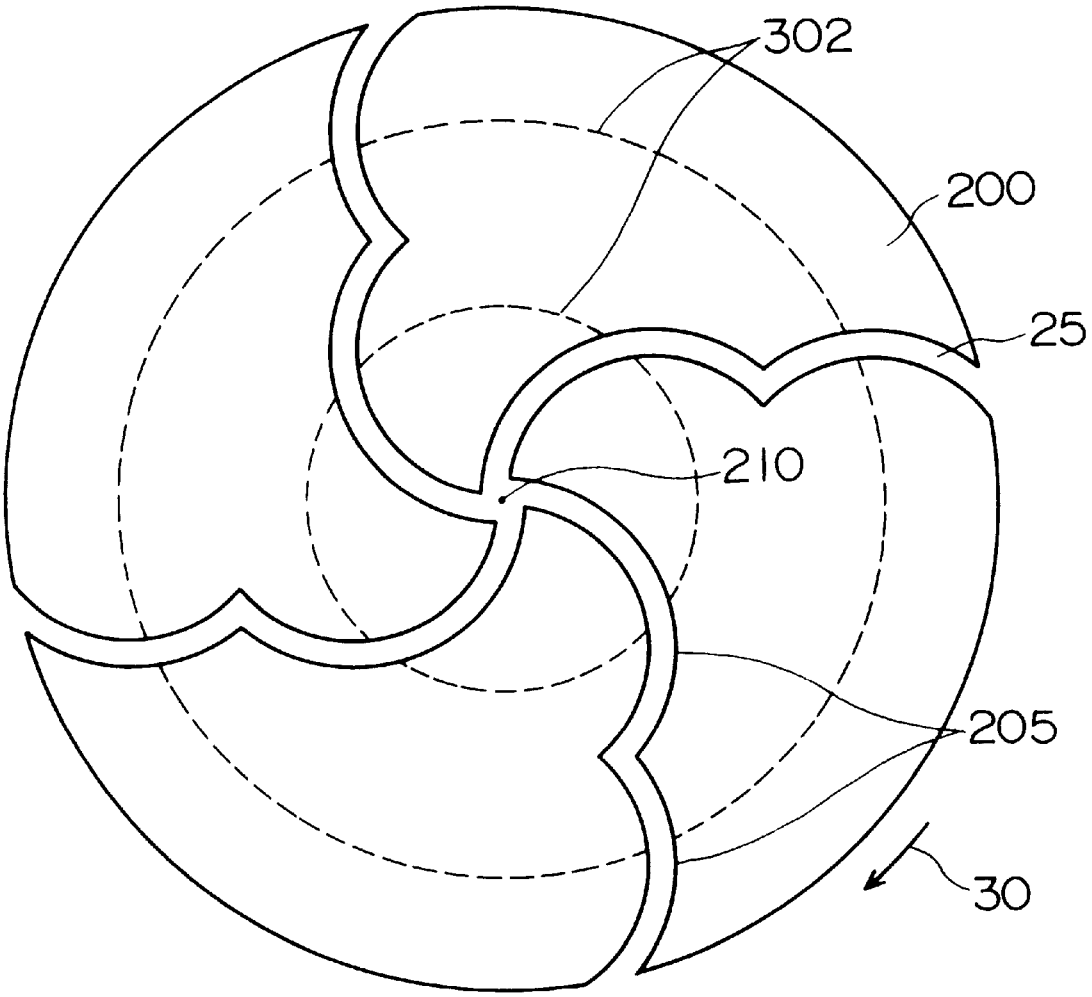
FIG. 6 is a schematic view of a pattern of grooves formed in a polishing pad according to a third embodiment of the present invention.

FIG. 6 shows a pattern of grooves formed in a polishing pad according to a third embodiment of the present invention. In the same way as the first embodiment, a groove 25 formed in the polishing pad base 200 is formed, with respect to the direction of rotation 30 of the polishing pad, so as to head in the direction of advance of the polishing pad as it heads toward the outer peripheral edge of the polishing pad. The groove of the polishing pad is further formed so that it has the largest projecting portion 205 in a direction opposite to the direction of advance of the polishing pad at the portion of lines 302 through which the polished wafer passes. The difference from the first embodiment resides in that a plurality of portions 205 which project out the most are formed in the direction opposite to the direction of advance. Due to this, the polishing slurry is delivered to the polished wafer from a plurality of positions, the quality of the polish such as the polishing rate and the uniformity in the plane is further enhanced, and more effective utilization of the polishing slurry is promoted.

According to the polishing pad of the present embodiment, in the same way as the first embodiment, the polishing slurry delivered to the center portion 210 of the polishing pad will spread out toward the outer periphery of the polishing pad due to the centrifugal force of the rotation of the polishing pad, but if the polishing pad of the present embodiment is used, the polishing slurry trying to flow out of the polishing pad 200 due to the centrifugal force is positively collected in this groove 25 and the accumulated polishing slurry is released again backward in the direction of rotation of the polishing pad from the portions of the groove portions 205 having the largest projecting portions and selectively delivered to the polished wafer passing through there. At this time, since there are a plurality of ports for releasing the polishing slurry again, the polishing slurry is more uniformly released again and delivered at the time of the polishing of the polished wafer, therefore the effective utilization of the polishing slurry and further enhancement of the quality of polishing become possible.

The polishing pad of the present embodiment can be used while being mounted in the polishing apparatus shown in for example FIG. 1. Further, it is possible to polish a processed substrate by using this polishing apparatus.

Fourth Embodiment

Figure 7:
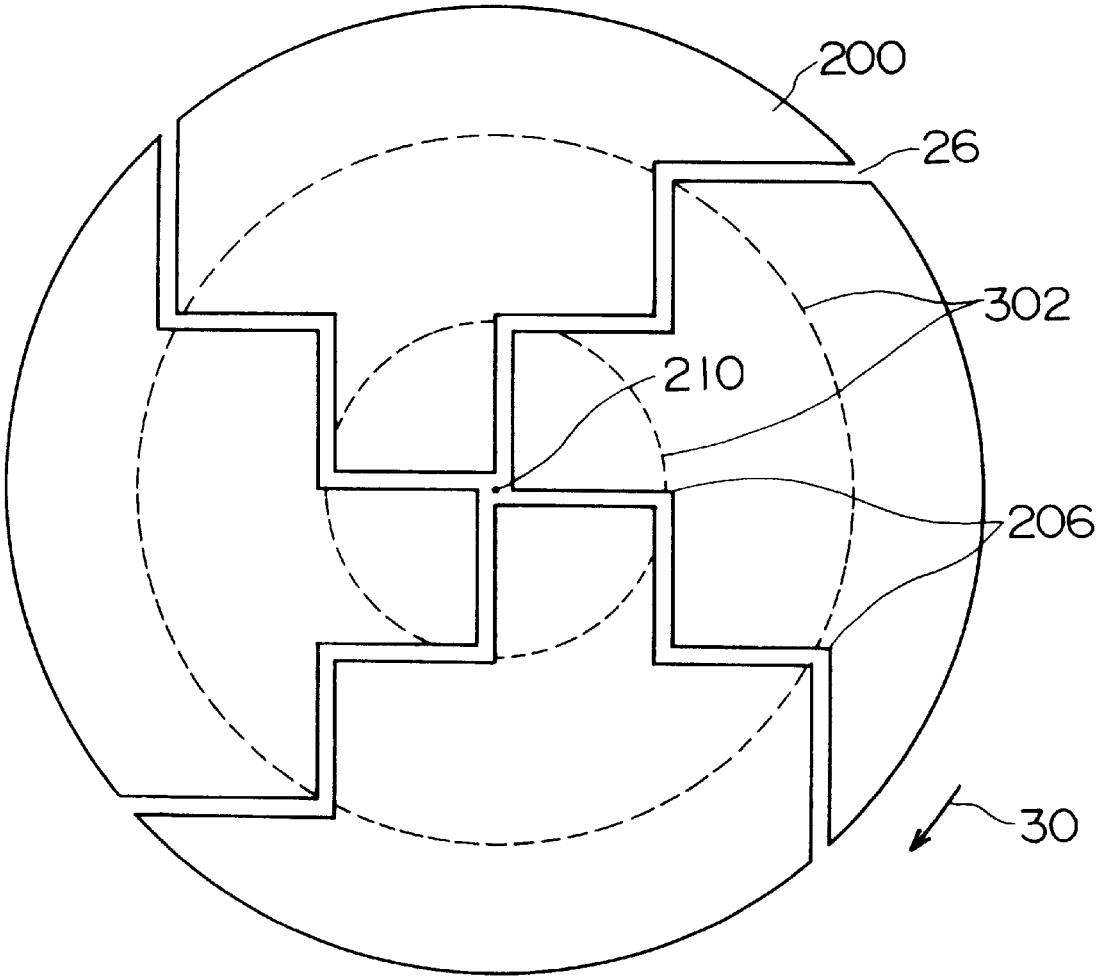
FIG. 7 is a schematic view of a pattern of grooves formed in a polishing pad according to a fourth embodiment of the present invention.

FIG. 7 shows a pattern of grooves formed in a polishing pad according to a fourth embodiment of the present invention. In the same way as the second embodiment, a groove 26 of the polishing pad base 200 is formed by straight lines giving a plurality of projecting angles 206 in the direction opposite to the direction of advance of the polishing pad at portions at lines 302 through which the polished wafer passes. According to the polishing pad of the present embodiment, in the same way as the third embodiment, the polishing slurry is sufficiently delivered at the time of the polishing of the polished wafer, whereby the effective utilization of the polishing slurry and the enhancement of the quality of the polishing become possible.

The polishing pad of the present embodiment can be used while being mounted in the polishing apparatus shown in for example FIG. 1. Further, it is possible to polish a processed substrate by using this polishing apparatus.

Fifth Embodiment

Figure 8:
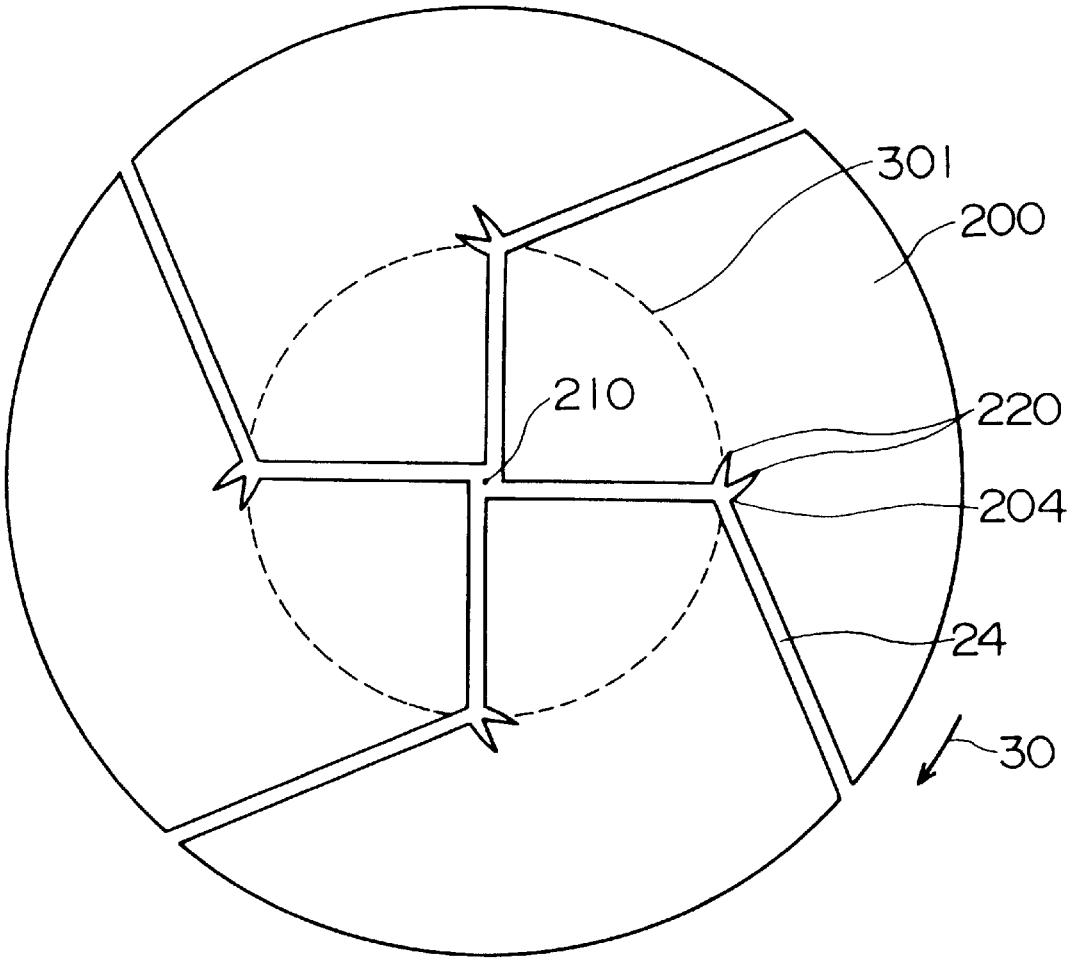
FIG. 8 is a schematic view of a pattern of grooves formed in a polishing pad according to a fifth embodiment of the present invention.

FIG. 8 shows a pattern of grooves formed in a polishing pad according to a fifth embodiment of the present invention. Here, the groove of the polishing pad shown in the second embodiment is provided at a projecting portion 204 with two extending portions 220 serving as ports for releasing the polishing slurry again in a directions opposite to the direction of rotation 30 of the polishing pad.

The polishing slurry delivered to the center portion 210 of the polishing pad will spread out toward the outer periphery of the polishing pad due to the centrifugal force of the rotation of the polishing pad, but if the polishing pad of the present embodiment is used, the polishing slurry trying to flow out of the polishing pad due to the centrifugal force is positively collected in this groove 24 and the accumulated polishing slurry is released again backward at several locations reliably from the extending portions 220 of the groove serving as the ports for releasing the polishing slurry newly provided at the groove portion 204 forming the largest projecting portion. With this pattern of grooves of the polishing pad, even though there is only one projecting portion, it becomes possible to deliver the polishing slurry to two or more positions just by adding the extending portions 220 and therefore improvement of the quality of the polishing of the polished wafer and effective utilization of the polishing slurry become possible.

The polishing pad of the present embodiment can be used while being mounted in the polishing apparatus shown in for example FIG. 1. Further, it is possible to polish a processed substrate by using this polishing apparatus.

Sixth Embodiment

Figure 9:
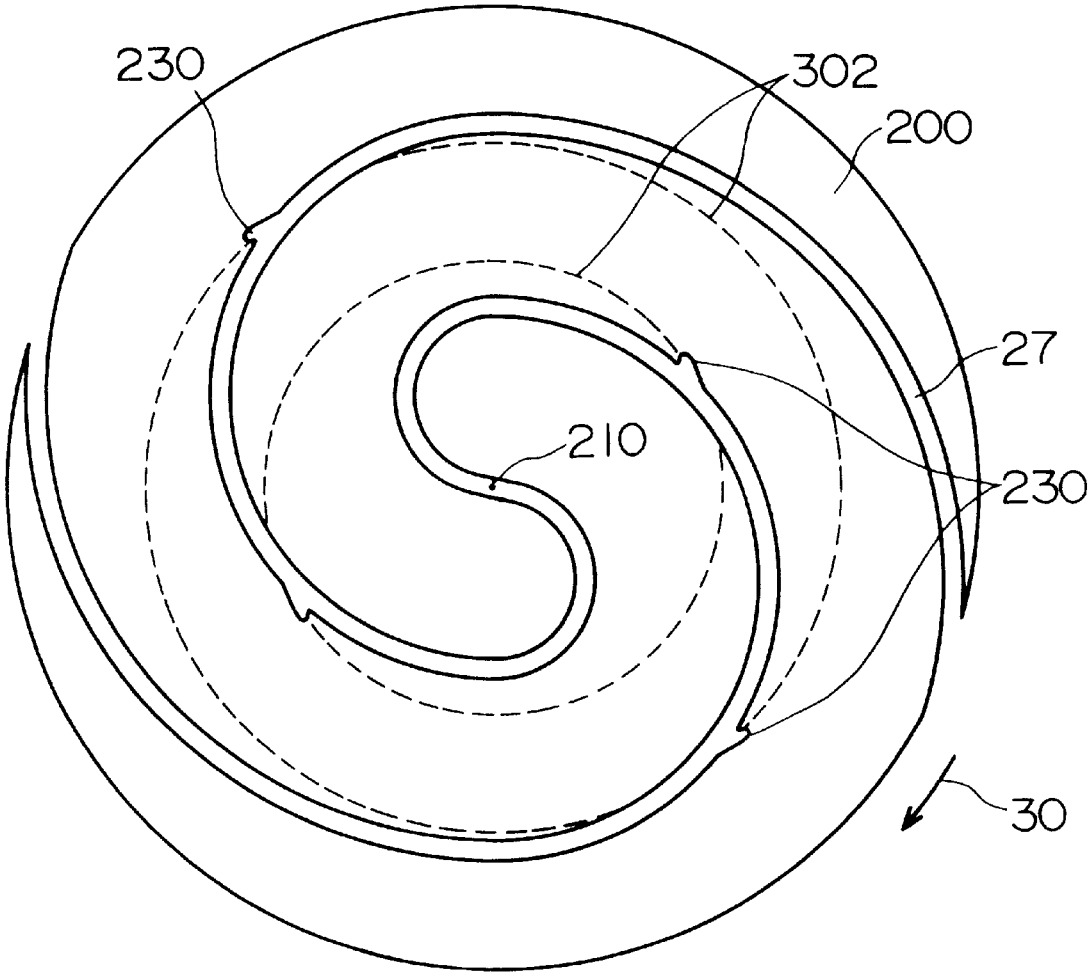
FIG. 9 is a schematic view of a pattern of grooves formed in a polishing pad according to a sixth embodiment of the present invention.

FIG. 9 shows a pattern of grooves formed in a polishing pad according to a sixth embodiment of the present invention. Here, a groove of the polishing pad is formed in a scroll manner. By this, it becomes possible to more reliably trap the polishing slurry when it is being ejected. Further, extending portions 230 of the groove serving as ports for releasing the polishing slurry are provided in the same way as in the fifth embodiment. The trapped polishing slurry is released again from there.

In the same way as in the fifth embodiment, the scroll shaped groove 27 is provided with the extending portions 230 serving as ports for releasing the polishing slurry at points at which the scroll shaped groove 27 intersects lines 302 through which the polished wafer passes. The polishing slurry is released again toward the polished wafer from there and therefore the polishing slurry is delivered from a plurality of positions to the polished wafer, whereby further enhancement of the quality of polishing and effective utilization of the polishing slurry become possible.

The polishing pad of the present embodiment can be used while being mounted in the polishing apparatus shown in for example FIG. 1. Further, it is possible to polish a processed substrate by using this polishing apparatus.

Summarizing the effects of the invention, as described above, it is possible to provide a polishing pad for chemical mechanical polishing for flattening etc. an inter-layer insulating film in the process of manufacture of a semiconductor device wherein, in addition to the formation of a dressed layer of the polishing pad by dressing of the pad by a dresser as in the related art, grooves are formed optimized in shape so that election of the polishing slurry to the outside of the polishing pad due to just the centrifugal force is prevented as much as possible and so that this polishing slurry is selectively delivered forward in a direction of advance of the wafer so that it becomes possible to effectively utilize the polishing slurry at the time of polishing for its originally intended polishing and thereby enable simultaneous achievement of a reduction of the process cost by the reduction of the amount of usage of the polishing slurry and an improvement of the polishing quality such as the polished shape of the wafer surface and the uniformity of polish by the increase of the opportunity of contact of the polishing slurry with the wafer.

Further, the polishing pad of the present invention can be used mounted in a polishing apparatus. Also, it is possible to polish a substrate by using this polishing apparatus. Due to this, it becomes possible to simultaneously achieve a reduction of the process cost by the reduction of the amount of usage of the polishing slurry and an improvement of the polishing quality such as the polished shape of the wafer surface and the uniformity of polish by the increase of the opportunity of contact of the polishing slurry with the wafer.

While the invention has been described by reference to specific embodiments chosen for purposes of illustration, it should be apparent that numerous modifications could be made thereto by those skilled in the art without departing from the basic concept and scope of the invention.

What is claimed is:

1. A polishing pad used for polishing by a chemical mechanical polishing method, comprising:

a first area at a side of a predetermined radial line of the polishing pad in a direction of normal rotation of the polishing pad during polishing, a second area at an opposite side of said polishing pad, relative to said first area, and grooves having first projecting portions projecting from a central axis of said polishing pad in a direction opposite to the direction of normal rotation of the polishing pad, where said first projecting portions are formed only in the second area.

2. A polishing pad as set forth in claim 1, wherein each of the grooves formed in the polishing pad is individually comprised of a plurality of straight grooves.

3. A polishing pad as set forth in claim 1, wherein each of the grooves formed in the polishing pad is individually comprised of a plurality of straight or arc-shaped grooves.

4. A polishing pad as set forth in claim 1, wherein each of the grooves formed in the polishing pad is individually comprised of a plurality of straight or arc-shaped grooves and has a plurality of second projecting portions in a direction opposite to the direction of normal rotation of the polishing pad.

5. A polishing pad as set forth in claim 4, wherein each of the grooves formed in the polishing pad is individually comprised of a plurality of straight or arc-shaped grooves and has one or more extending portions, which project out in a direction opposite to the direction of normal rotation of the polishing pad, at each of said second projecting portions.

6. A polishing pad as set forth in claim 1, wherein each of the grooves formed in the polishing pad individually extends from an outer peripheral edge to a center point of the polishing pad in a direction opposite to the direction of normal rotation of the polishing pad, is a straight or arc-shaped groove, and has one or more extending portions which project out in a direction opposite to the direction of normal rotation of the polishing pad at least at one location per groove.

7. A polishing pad as set forth in claim 1, wherein each of the grooves formed in the polishing pad extends from an outer peripheral edge to a center point of the polishing pad in a direction opposite to the direction of normal rotation of the polishing pad and has a plurality of second projecting portions in a direction opposite to the direction of normal rotation or the polishing pad.

8. A polishing pad as set forth in claim 1, wherein the polishing pad is formed of a material selected from foamed polyurethane, nonfoamed polyurethane, a silicone resin, polyethylene fluoride resin, polyvinyl chloride resin, hard rubber, and mixtures of the same.

9. A polishing apparatus, which comprises:

a polishing pad for polishing by a chemical mechanical polishing method, wherein the polishing pad comprises:

a first area at a side of a predetermined radial line of the polishing pad in the direction of normal rotation of the polishing pad during polishing;

a second area at an opposite side of said polishing pad, relative to said first area; and grooves having first projecting portions projecting from a central axis of said polishing pad in a direction opposite to the direction of normal rotation of the polishing pad, where said first projecting portions are formed only in the second area.

10. A polishing apparatus as set forth in claim 9, wherein each of the grooves formed in the polishing pad is individually comprised of a plurality of straight grooves.

11. A polishing apparatus as set forth in claim 9, wherein each of the grooves formed in the polishing pad is individually comprised of a plurality of straight or arc-shaped grooves.

12. A polishing apparatus as set forth in claim 9, wherein each of the grooves formed in the polishing pad is individually comprised of a plurality of straight or arc-shaped grooves and has a plurality of second projecting portions in a direction opposite to the direction of normal rotation of the polishing pad.

13. A polishing apparatus as set forth in claim 12, wherein each of the grooves formed in the polishing pad is individually comprised of a plurality of straight or arc-shaped grooves and has one or more extending portions, which project out in a direction opposite to the direction of normal rotation of the polishing pad, at each of said second projecting portions.

14. A polishing apparatus as set forth in claim 9, wherein each of the grooves formed in the polishing pad individually extends from an outer peripheral edge to a center point of the polishing pad in a direction opposite to the direction of normal rotation of the polishing pad, is a straight or arc-shaped groove, and has one or more extending portions which project out in a direction opposite to the direction of normal rotation of the polishing pad at least at one location per groove.

15. A polishing apparatus as set forth in claim 9, wherein each of the grooves formed in the polishing pad extends from an outer peripheral edge to a center point of the polishing pad in a direction opposite to the direction of normal rotation of the polishing pad and has a plurality of second projecting portions in a direction opposite to the direction of normal rotation or the polishing pad.

16. A polishing apparatus as set forth in claim 9, wherein the polishing pad is formed of a material selected from foamed polyurethane, nonfoamed polyurethane, a silicone resin, polyethylene fluoride resin, polyvinyl chloride resin, hard rubber, and mixtures of the same.

* * * * *

UNITED STATES PATENT AND TRADEMARK OFFICE

CERTIFICATE OF CORRECTION

PATENT NO. : 6,159,088
DATED : December 12, 2000
INVENTOR(S) : Hideharu Nakajima It is certified that error appears in the above-identified patent and that said Letters Patent is hereby corrected as shown below:

Column 11, claim 7,
Line 11, change "or" to -- of --.

Column 12, claim 15,
Line 29, change "or" to -- of --.

Signed and Sealed this

Twenty-sixth Day of February, 2002

*Attest:*

*Attesting Officer*

JAMES E. ROGAN
*Director of the United States Patent and Trademark Office*